United States Patent [19]

Brinkerhoff

[11] 4,242,878

[45] Jan. 6, 1981

[54] ISOTHERMAL COMPRESSOR APPARATUS AND METHOD

[75] Inventor: VerDon C. Brinkerhoff, Salt Lake City, Utah

[73] Assignee: Split Cycle Energy Systems, Inc., Salt Lake City, Utah

[21] Appl. No.: 5,415

[22] Filed: Jan. 22, 1979

[51] Int. Cl.[3] ..... F25D 15/00

[52] U.S. Cl. ..... 62/119; 62/403; 62/505; 92/144; 123/41.2; 165/105; 417/243

[58] Field of Search ..... 62/505, 403, 119; 165/105; 417/243; 92/144; 123/41.2

[56] References Cited

U.S. PATENT DOCUMENTS

| | | | |
|---|---|---|---|
| 1,183,077 | 5/1916 | Koenig | 92/144 |
| 1,840,265 | 1/1932 | Spohrer | 417/243 |
| 3,300,997 | 1/1967 | Kocher | 62/505 |
| 3,448,729 | 6/1969 | Parsons | 123/41.2 |

*Primary Examiner*—Ronald C. Capossela
*Attorney, Agent, or Firm*—J. Winslow Young; H. Ross Workman; Rick D. Nydegger

[57] ABSTRACT

An isothermal compressor apparatus and method, the apparatus including a compression chamber, a piston operable in the compression chamber and an evaporation chamber disposed in heat exchange relationship with the compression chamber, the evaporation chamber being interconnected with a closed refrigerant system. Valves control the flow of compressible gas through the compression chamber while heat exchange coils carry the compressed gas from the compression chamber through the evaporation chamber. The method includes compressing a gas and rapidly removing thermal energy imparted to the gas by the compression process with a refrigerant in the evaporation chamber.

14 Claims, 2 Drawing Figures

ISOTHERMAL COMPRESSOR APPARATUS AND METHOD

BACKGROUND

1. Field of the Invention

This invention relates to compressors and, more particularly, to an isothermal compressor apparatus and method for isothermally compressing a compressible gas.

2. The Prior Art

Compressors are well known in the art with their primary function being to increase the energy of a fluid and, more particularly, increase the pressure or compress a compressible gas. A typical compressor includes a reciprocating piston operating in a cylinder with valves controlling the movement of gas through the cylinder.

It is well known that compression of a compressible gas not only increases pressure but causes heating of the gas by the work of compression. The compressible gas is considerably hotter at the discharge than at the inlet. The gain in pressure imparted by a single-stage compressor is limited by the heating so that for high discharge pressures multistage compressors are required. The power required to compress a gas depends upon (1) the inlet temperature since compression of a hot gas requires more work than a cold gas and (2) the mechanical efficiency of the compressor which efficiency varies with the compression ratio. The compression ratio is defined as the ratio of the absolute discharge pressure to the absolute inlet pressure. Additionally, the absolute discharge pressure over the inlet pressure is proportional to the temperature of the discharge gas over the inlet temperature. To further understand the relationship of the temperature of a compressed gas with its pressure, the temperature of the compressed gas leaving a compressor cylinder (and before cooling) may be estimated from the expression for the adiabatic discharge temperature:

$$T_b = T_a (P_b/P_a)$$

Wherein Ta and $T_b$ are the absolute temperatures at suction and discharge, respectively, and Pa and $P_b$ are the inlet and discharge pressures, respectively. From the foregoing, it is clear that a substantial portion of the energy imparted to the compressible gas is in the form of thermal energy. This thermal energy has a direct effect on the pressure of the compressible gas and thereby interferes with the overall mechanical efficiency of the compressor. Additionally, unless captured by other means, this thermal energy is lost to the ambient thereby further lowering the overall energy efficiency of the compressor.

In view of the foregoing, it would be significant advancement in the art to provide an isothermal compressor apparatus and method whereby a compressible gas is isothermally compressed with the thermal energy imparted thereto being recovered and suitable utilized. It would also be an advancement in the art to provide an isothermal compressor apparatus whereby an evaporation chamber for removing thermal energy from the compressed gas is placed in close proximity to the compression chamber thereby providing more efficient transfer of the thermal energy from the compressed gas to a refrigerant in the evaporation chamber.

BRIEF SUMMARY AND OBJECT OF THE INVENTION

The present invention relates to a novel apparatus and method for isothermally compressing a compressible gas. The method includes removing thermal energy from the gas wherein the thermal energy is imparted to the gas by the work of compression. The thermal energy is absorbed from the compressible gas by evaporating a refrigerant in an evaporation chamber placed in close proximity to the compression chamber. The refrigerant is contained within a closed system so that condensed refrigerant is continuously returned to the evaporation chamber. Novel check valve apparatus control the flow of compressible gas through the compression chamber.

It is, therefore, a primary object of this invention to provide improvements in isothermal compressors.

Another object of this invention is to provide an improved method of isothermally compressing a compressible gas.

Another object of this invention is to provide a compressor apparatus whereby the temperature of the compressed gas is lowered by removing thermal energy from the compressed gas.

Another object of this invention is to provide a compressor apparatus whereby an evaporation chamber and a compression chamber are contained within a cylinder with a thin wall member separating the evaporation chamber from the compression chamber thereby providing rapid heat exchange therebetween.

Another object of this invention is to provide a dome-shaped compression chamber and a matching, dome-shaped piston operable within the compression chamber.

These and other objects and features of the present invention will become more fully apparent from the following description and appended claims taken in conjunction with the accompanying drawing.

DETAILED DESCRIPTION OF THE PREFERRED EMBODIMENTS

Figure 1:
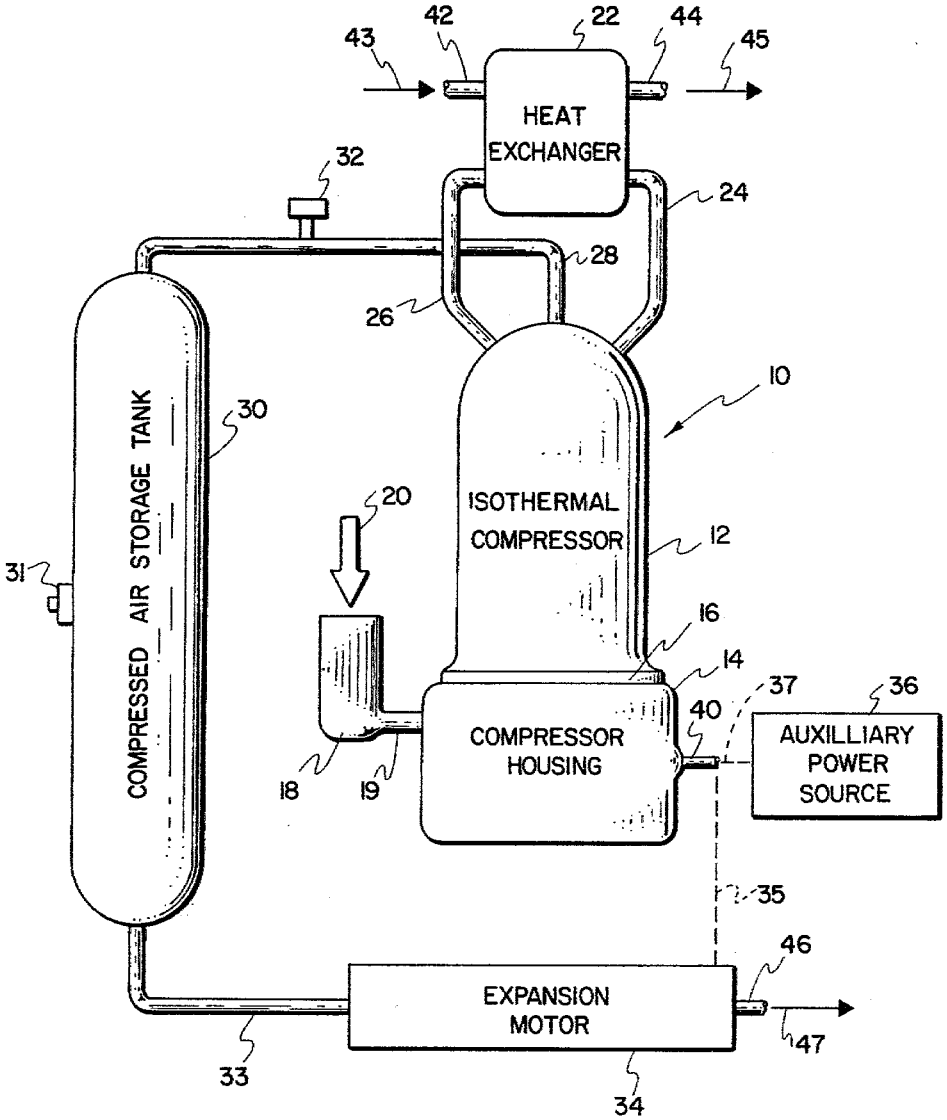
FIG. 1 is a schematic flow diagram of a preferred embodiment of the isothermal compressor apparatus.

The invention is best understood by reference to the drawing wherein like parts are designated with like numerals throughout.

Referring now more particularly to FIG. 1, the isothermal compressor apparatus of this first preferred embodiment of the invention is shown generally at 10 and includes an isothermal compressor 12 surmounted over a compressor housing 14 and interconnected with a compressed air storage tank 30 through a conduit 28. Air for isothermal compressor 12 is supplied from air 20 and is filtered through a filter 18 mounted to compressor housing 14. A pressure release valve 32 is interposed in conduit 28 for the purpose of releasing excess pressures within the compressed gas system. Compressed air may be suitably utilized through an outlet 31 or may be directed through a conduit 33 to a conventional expansion motor 34. Advantageously, expansion motor 34 can be any suitable, conventional expansion motor such as a turbine or the like, with the mechanical energy produced thereby being suitably interconnected by mechanical linkage 35 to a crankshaft 40. As is well known in the art, expansion motor 34 removes energy from the compressed air and converts that energy to mechanical energy for linkage 35. Correspondingly, a discharge stream 47 from expansion motor 34 is discharged at a substantially lower pressure and, correspondingly, lower temperature through an outlet 46. This cooled discharge gas 47 may be diverted for use in air conditioning or any other system which can suitably utilize a cooled air stream. Since it is impossible for expansion motor 34 to provide all of the necessary mechanical power for the operation of isothermal compressor 12, an auxiliary power source 36 such as an electric motor, or the like is interconnected to crankshaft 40 by mechanical linkage 37.

A heat exchanger 22 is interconnected with isothermal compressor 12 through evaporated refrigerant conduit 24 and condensed refrigerant conduit 26. Heat exchanger 22 is also interconnected through an inlet conduit 42 and an outlet conduit 44 for a cold stream 43 and a heated stream 45, respectively. Heat exchanger 22 removes thermal energy from refrigerant passing therethrough and transfers the same to heated stream 45. Heated stream 45 can be utilized as a preheater for a water heater (not shown) or the like or for any other suitable purpose.

Figure 2:
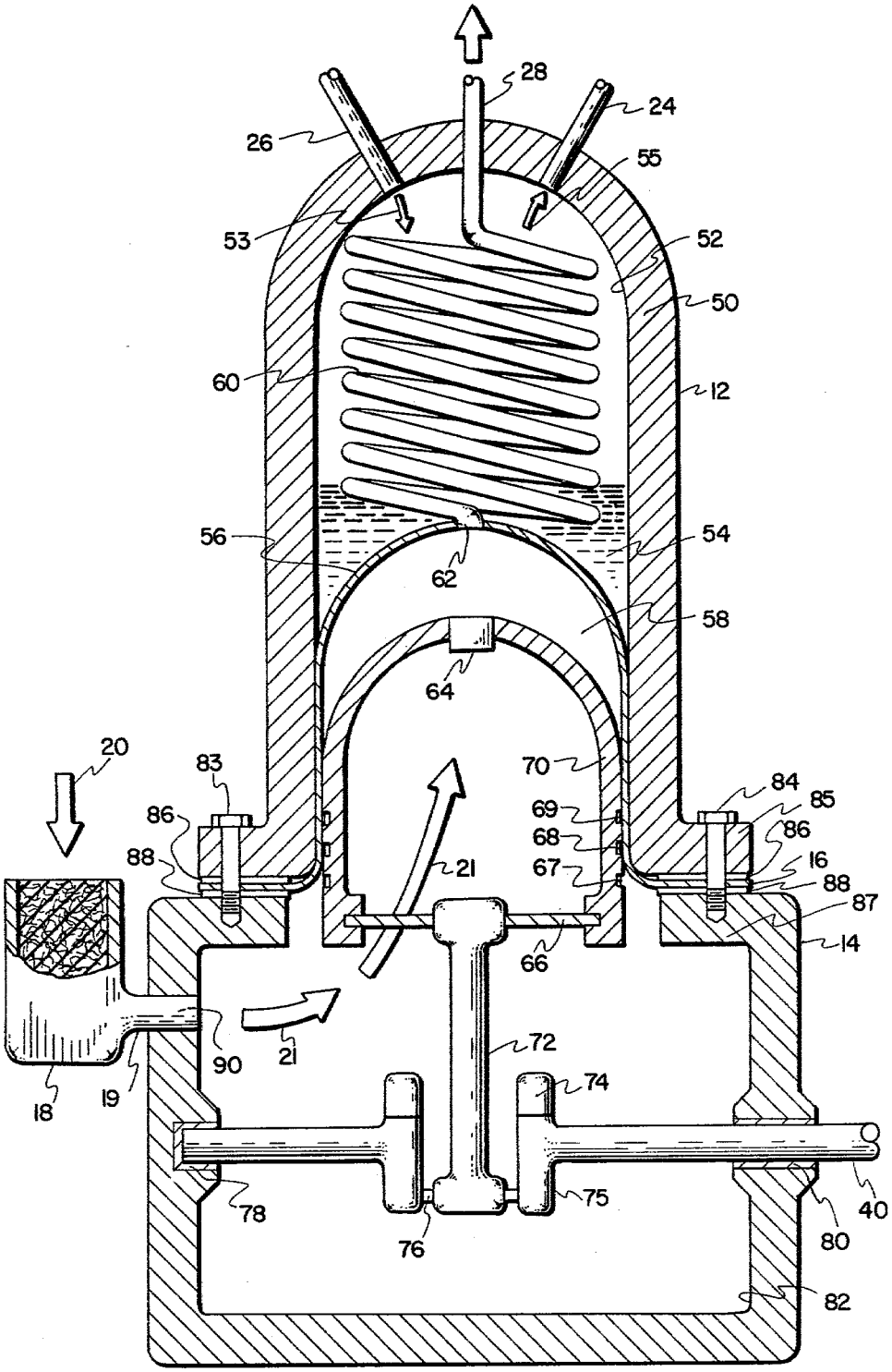
FIG. 2 is a partial cross section of a portion of the preferred embodiment of the isothermal compressor apparatus of FIG. 1.

Referring now more particularly to FIG. 2, isothermal compressor 12 is shown in greater detail as a compressor dome 50 segregated into an expansion chamber 52 and a compression chamber 58 by a compression shell 56. Compression shell 56 defines compression chamber 58 and has an internal contour corresponding to the external contour of a piston 70 reciprocating in compression chamber 58. Compression shell 56 is configurated as a thin wall member for insertion in compressor dome 50. The thin wall provides improved heat transfer characteristics to compression shell 56. An annular flange 16 on compression shell 56 is adapted to be clamped between gaskets 86 and 88 by bolting flange 85 to rim 87 by bolts 83 and 84.

Compressor housing 14 is configurated as a conventional crankcase 82 for a body of lubricant (not shown) and as the necessary support structure for crankshaft 40. Crankshaft 40 is configurated as a conventional crankshaft supported by bearings 78 and 80 and having a crank 75 therein. Crank 75 is a conventional crank including counterweight lobes 74 and is interconnected to a piston rod 72 by a pin 76. A corresponding wrist pin 66 interconnects connecting rod 72 with piston 70. Piston 70 is thereby adapted for reciprocating movement within compression chamber 58 upon rotation of crankshaft 40. Accordingly, rotary movement of crankshaft 40 and, more particularly, crank 75 is translated into a linear, reciprocatory movement of piston 70.

The primary difference between crankcase 82 and a conventional crankcase is the provision for the passage of air therethrough as illustrated schematically by arrow 21. Air filter 18 is interconnected by a conduit 19 to inlet 90 in crankcase 82 and filters air 20 which becomes filtered air 21. Filtered air 21 passes upwardly through the hollow body of piston 70 through a check valve 64 into compression chamber 58.

The outlet from compression chamber 58 is configurated as a check valve 62 which opens into heat exchange coil 60. Heat exchange coil 60 is interconnected between compression chamber 58 and conduit 28 and provides an increased heat exchange surface within evaporation chamber 52. A body of refrigerant 54 is contained within evaporation chamber 52 and is in intimate contact with compression shell 56 and the bottom portion of heat exchange coil 60. Evaporated refrigerant is illustrated schematically as arrow 55 passing into evaporated refrigerant conduit 24 while condensed refrigerant is illustrated schematically at arrow 53 returning through condensed refrigerant conduit 26.

In operation, the downward stroke of piston 70 closes check valve 62 and forces filtered inlet air 21 upwardly through check valve 64 into compression chamber 58. Upward movement of piston 70 closes inlet check valve 64 and compresses the air in compression chamber 58 between piston 70 and compression shell 56. The compressed air escapes through check valve 62 into heat exchange coil 60.

An overlying body of condensed refrigerant 54 is in intimate thermal contact through the thin wall of compression shell 56 thereby serving to remove thermal energy rapidly from the compressed air in compression chamber 58. The thermal energy in the compressed air has been imparted thereto by the work of compressing the air. Thermal energy absorbed by refrigerant 54 evaporates or otherwise volatilizes a portion of refrigerant 54 creating an evaporated refrigerant 55 which passes upwardly through evaporated refrigerant conduit 24. Evaporated refrigerant 55 passes through heat exchanger 22 (FIG. 1) where it releases thermal energy and condenses to form condensed refrigerant 53. Condensed refrigerant 53 is returned to expansion chamber 52 by condensed refrigerant conduit 26 and is directed to splash downwardly over heat exchange coils 60 thereby further chilling the compressed air in heat exchange coils 60. Accordingly, the compressed air in isothermal compressor 12 is suitably cooled during and immediately after compression so that the work energy imparted thereto as thermal energy can be readily removed therefrom and recovered in heat exchanger 22. Thus, the overall work required for compressing the compressible gas is substantially reduced thereby lowering the input work requirement for rotation of crankshaft 40.

Advantageously, the design of isothermal compressor 12 is such that the desired results are achieved efficiently and economically. For example, compression shell 56 is fabricated from a thin wall material having the desired strength and heat transfer characteristics so as to provide a desired degree of heat transfer into refrigerant 54. Additionally, compression shell 56 is fabricated with a hemispherical, dome-like configuration in the form of a sleeve insert to snugly fit inside compressor dome 50. Compression shell 56 thereby forms a close-fitting liner for piston 70 to act in cooperation with compression rings 67–69 to suitably compress air in compression chamber 58. Compression shell 56 also provides a simplified assembly of isothermal compressor 12 by being readily insertable into compressor dome 50 and secured therein by bolts 83 and 84. Assembly is further facilitated by heat exchange coil 60 being fabricated from a sufficiently resilient material such as copper to accommodate being extended to provide interconnection between compression shell 56 and the upper end of compressor dome 50 prior to insertion of compression shell 56 into compression dome 50. Furthermore, the dome-like shape of compression shell 56 provides well-known strength characteristics for the pressures encountered thereby. Additionally, the dome-like shape provides a substantially enlarged surface area for heat exchange with refrigerant 54. These numerous advantages of compression shell 56 contribute significantly to the success of this invention. Further advantages in design are achieved by enclosing the refrigerant 54 in expansion chamber 52 so that the pressures exerted by refrigerant 54 offset the pressures exerted inside compression chamber 58 further reducing the required shell thickness of compression shell 56.

The invention may be embodied in other specific forms without departing from its spirit or essential characteristics. The described embodiments are to be considered in all respects only as illustrative and not restrictive and the scope of the invention is, therefore, indicated by the appended claims rather than by the foregoing description. All changes that come within the meaning and range of equivalency of the claims are to be embraced within their scope.

What is claimed and desired to be secured by a U.S. Letters Patent is:

1. A compressor comprising:

a compression chamber defined by a thin-wall element having a hemispherical profile;

a piston operable in the compression chamber to compress a compressible gas;

valve means for admitting the compressible gas into the compression chamber;

conduit means for removing compressed gas from the compression chamber;

cooling means for cooling the compressible gas comprising an evaporation chamber disposed about at least a portion of the hemispherical profile of the compression chamber, the evaporation chamber containing a body of liquid having a predetermined heat of vaporization to accommodate removal of at least a portion of the thermal energy from the compressible gas wherein the thermal energy is in the compressible gas resulting from compression of the compressible gas; and heat exchange means for removing the thermal energy from the evaporated liquid.

2. The compressor defined in claim 1 wherein the thin-wall element is disposed between the compression chamber and the evaporation chamber.

3. The compressor defined in claim 1 wherein the piston is configurated with a hemispherical profile corresponding to the hemispherical profile of the thin wall element.

4. The compressor defined in claim 1 wherein the thin-wall element is configurated as a sleeve for insertion into a cylinder, the sleeve thereby segregating the cylinder into the compression chamber and the evaporation chamber.

5. The compressor defined in claim 1 wherein the valve means is interposed in the piston.

6. The compressor defined in claim 1 wherein the cooling means comprises a closed loop system comprising a refrigerant.

7. The compressor defined in claim 6 wherein the closed loop system comprises an external heat exchange means.

8. The compressor defined in claim 6 wherein the closed loop system further comprises circulating means for removing a vaporized refrigerant gas from the evaporation chamber and returning condensed refrigerant gas to the evaporation chamber.

9. The compressor defined in claim 6 wherein the cooling means further comprises heat exchange means in the evaporation chamber.

10. The compressor defined in claim 9 wherein the heat exchange means comprises a coil of tubing for carrying the compressed gas through the evaporation chamber in heat exchange relationship therewith.

11. An isothermal compressor comprising:

a crankcase having a crankshaft rotatably mounted therein;

a cylinder superimposed over the crankcase and having a first end and a second end;

a compression chamber formed in the first end of the cylinder, the compression chamber having an outlet for compressed gas;

an evaporation chamber formed in the second end of the cylinder;

a divided fabricated as a thin-wall sleeve insertable in the cylinder, the sleeve having a closed end and separating the compression chamber from the evaporation chamber;

a piston interconnected with the crankshaft and operable for reciprocatory movement in the compression chamber upon rotation of the crankshaft;

gas intake means in the crankcase;

valve means in the piston for admitting gas into the compression chamber through the piston; and cooling means in the evaporation chamber for cooling compressed gas from the compression chamber thereby providing isothermal compression of the gas.

12. The isothermal compressor defined in claim 11 wherein the thin-wall sleeve is configurated with a dome-like closed end and the piston is configurated with a corresponding dome-like profile.

13. A method for removing thermal energy from a compressed gas comprising:

fabricating a cylinder;

preparing a compression chamber in the cylinder with a piston cooperating therein for compressing a gas in the compression chamber by fabricating a closed-end sleeve insertable in the cylinder;

segregating the cylinder into the compression chamber and an expansion chamber with the closed-end sleeve thereby placing the expansion chamber in heat exchange relationship to the compression chamber; and removing thermal energy from a compressed gas in the compression chamber by providing a refrigerant to the expansion chamber, the refrigerant absorbing the thermal energy from the compressed gas.

14. The method defined in claim 13 wherein the fabricating step further comprises shaping the sleeve with a dome-like configuration while providing the piston with a corresponding dome-like rofile.

* * * * *